US010948258B1

(12) United States Patent
Kitts

(10) Patent No.: US 10,948,258 B1
(45) Date of Patent: Mar. 16, 2021

(54) ARCHERY ACCESSORY MOUNTING BRACKET

(71) Applicant: Randy Kitts, Ball Ground, GA (US)

(72) Inventor: Randy Kitts, Ball Ground, GA (US)

( * ) Notice: Subject to any disclaimer, the term of this patent is extended or adjusted under 35 U.S.C. 154(b) by 0 days.

(21) Appl. No.: 16/546,997

(22) Filed: Aug. 21, 2019

(51) Int. Cl.
*F41B 5/14* (2006.01)
*F41B 5/06* (2006.01)

(52) U.S. Cl.
CPC ..... *F41B 5/1403* (2013.01); *F41B 5/1453* (2013.01); *F41B 5/066* (2013.01)

(58) Field of Classification Search
CPC ..... F41B 5/14; F41B 5/1453; F41B 5/1403; F41B 5/066; F16M 13/02
USPC ..... 124/86, 88, 23.1; 248/200, 218.4, 219.3
See application file for complete search history.

(56) References Cited

U.S. PATENT DOCUMENTS 3,022,898 A * 2/1962 Loeb ..... F41A 23/18 211/64
3,963,156 A * 6/1976 Perrin ..... A45F 5/021 224/268
4,121,743 A * 10/1978 Burton ..... F41B 5/1461 224/271
4,684,047 A * 8/1987 Burgwin ..... A45F 5/02 224/248
4,722,501 A * 2/1988 Ruhl ..... F41B 5/14 248/218.4
4,788,961 A * 12/1988 Toth ..... F41B 5/066 124/25.5
5,310,151 A * 5/1994 Engel ..... F21V 21/08 248/219.4
5,400,764 A * 3/1995 Spolar ..... F41G 1/467 124/87
5,482,241 A * 1/1996 Oglesby ..... F41B 5/14 124/23.1
5,491,920 A * 2/1996 McCullers ..... F41A 23/00 42/94
5,685,103 A * 11/1997 Wiggins ..... F41A 23/18 211/64
5,697,537 A * 12/1997 Bowlsby ..... F41B 5/14 224/270
5,725,135 A * 3/1998 Daniel ..... F41C 33/02 224/249
5,857,651 A * 1/1999 Kunevicius ..... F41B 5/14 248/218.4
5,930,931 A * 8/1999 Watson ..... F41C 33/001 42/94

(Continued)

*Primary Examiner* — Alexander R Niconovich
(74) *Attorney, Agent, or Firm* — Donald J. Ersler

(57) ABSTRACT

An archery accessory mounting bracket is directly mounted with fasteners to an archery bow or crossbow; hung from a tree via a t-handle screw; secured to a tree with a belt; worn by an human with a belt; and engaged with a pipe. Further, an archery accessory mounting bracket is manufactured with a stud for three hundred sixty degrees of rotation for proper alignment of an archery accessory. The archery accessory mounting bracket includes a belt receiver opening for insertion of a belt. The belt may be retained on an individual or wrapped around an object such as a tree, tree stand, or hunting blind. A 360 degree archery accessory mounting base includes at least one t-screw receiver opening for a t-screw, a stud and at least one fastener hole. An archery accessory mounting bracket head includes a stud opening for receiving the stud and secured with a tension nut.

4 Claims, 8 Drawing Sheets

(56) References Cited

U.S. PATENT DOCUMENTS 6,059,240 A * 5/2000 Gorsuch ..... F41B 5/14 124/86
6,266,910 B1 * 7/2001 Horine ..... F41C 33/00 224/192
6,419,097 B1 * 7/2002 Anderson ..... F41A 23/18 211/85.7
6,478,272 B1 * 11/2002 McKinsey ..... A01M 31/02 248/216.1
6,588,440 B2 * 7/2003 Varnado ..... A01M 31/025 135/120.1
6,672,299 B2 * 1/2004 Proctor ..... F41B 5/066 124/86
6,948,690 B1 * 9/2005 Sandel ..... F41B 5/14 124/86
6,988,755 B2 * 1/2006 Lukas ..... F41A 35/00 224/913
7,290,689 B2 * 11/2007 Oxley ..... F41B 5/1461 224/270
7,464,908 B2 * 12/2008 Files ..... F41B 5/066 124/86
7,607,626 B2 * 10/2009 Whitmire ..... F41B 5/06 182/92
7,861,987 B2 * 1/2011 Gorsuch ..... F41B 5/14 248/219.1
7,975,973 B1 * 7/2011 Weeden ..... F16M 11/14 248/216.1
8,016,134 B1 * 9/2011 Templin ..... F16M 13/022 211/85.7
8,025,193 B1 * 9/2011 Gornall, Jr. ..... A45F 3/14 224/268
8,087,195 B2 * 1/2012 Minges ..... A47B 57/06 42/94
8,201,785 B2 * 6/2012 Goodman ..... G08B 13/19632 248/181.1
8,231,095 B2 * 7/2012 Bean ..... F41B 5/14 248/323
8,505,527 B2 * 8/2013 Kempf ..... F41B 5/066 124/86
8,561,952 B2 * 10/2013 Pfeiler ..... F16M 11/2014 248/218.4
8,607,497 B2 * 12/2013 Green ..... A01K 87/00 43/21.2
8,683,909 B1 * 4/2014 Copus ..... F41A 23/16 89/37.04
8,714,503 B1 * 5/2014 Fadrow ..... F41B 5/148 248/231.71
8,763,297 B2 * 7/2014 Boll ..... F41A 23/06 42/94
8,839,776 B2 * 9/2014 Kingsbury ..... F41B 5/1426 124/89
9,151,440 B1 * 10/2015 Martin ..... F16M 13/02
9,400,153 B2 * 7/2016 Evans ..... F41B 5/066
9,593,903 B1 * 3/2017 Sanchez ..... F41B 5/1453
9,772,158 B1 * 9/2017 Staton ..... F41A 23/18
2003/0038218 A1 * 2/2003 Eppard ..... F16M 11/2092 248/219.4
2006/0065261 A1 * 3/2006 Files ..... F41B 5/066 124/86
2006/0231707 A1 * 10/2006 Schrot ..... A01M 31/02 248/218.4
2008/0099655 A1 * 5/2008 Goodman ..... F16M 11/14 248/674
2009/0078500 A1 * 3/2009 Wydner ..... A01M 31/02 182/3
2009/0321186 A1 * 12/2009 Louchart ..... A01M 31/02 182/188
2010/0043765 A1 * 2/2010 Lang ..... F41B 5/1403 124/25.6
2010/0314514 A1 * 12/2010 Nelson ..... F16M 11/08 248/219.1
2011/0120440 A1 * 5/2011 Stokes ..... F41B 5/1426 124/89
2018/0023916 A1 * 1/2018 Bunch ..... F16M 13/02 248/636
2019/0049210 A1 * 2/2019 Bunch ..... F41B 5/1453

* cited by examiner

ARCHERY ACCESSORY MOUNTING BRACKET

BACKGROUND OF THE INVENTION

1. Field of the Invention

The present invention relates generally to archery and more specifically to an archery accessory mounting bracket for archery accessories such as an archery quiver. The present invention may be used with any type of accessory where there is a desire to provide a selective engagement and disengagement of a first object with a third object through a device of a second object, wherein the first object may be an accessory mounting device, the third object may be an accessory, and the second object may be a device for engaging the third object with the first object.

2. Discussion of the Prior Art

Historically, archery quiver mounts have been used by archers to hold and transport arrows, until the archer is ready to use them. Over the years, many different styles have been produced. The most versatile style is a kind of quiver that attaches to the archery bow or crossbow, and has a quick-release feature that allows for removal of the quiver from the hunting device. Quivers mounts designed to hold quivers have always had inherent restrictions placed upon them due to the design and function of the mount. A quiver mount would either mount the quiver to a bow or crossbow, or sometimes even to a tree or tree stand, but the mount was still limited in versatility.

Although the prior art accomplishes the task of securing the quiver to a bow or crossbow, they are all limited in the versatility of mounting locations and lack the function of full rotation of the mounting bracket.

Accordingly, there is a clearly felt need in the art for an archery accessory mounting bracket that may be engaged with many objects and allows the accessory to be selectably rotated 360 degrees on the mount.

SUMMARY OF THE INVENTION

The present invention provides an archery accessory mounting bracket that is directly mounted with fasteners to an archery bow or crossbow; may be hung from a tree via a t-handle screw; may be secured to a tree via a belt; may be worn by an individual via a belt; and may be engaged with a pipe. Further, the archery accessory mounting bracket may be manufactured with three hundred sixty degrees of rotation for proper alignment of an archery accessory. In its simplest form, the archery accessory mounting bracket may be fabricated from a single piece of material or multiple pieces of material. The archery accessory mounting bracket may be sized to allow a user's belt to pass through belt receiver opening to allow a belt to hold the archery accessory mounting bracket in a desired location, such as on the individual, or around an object such as a tree, tree stand, or hunting blind.

The archery accessory mounting bracket may be manufactured to allow three hundred sixty degrees of rotation thereof. In a preferred embodiment, an archery accessory mounting bracket base would include a belt receiver opening for a belt, receiver openings for a t-handle, a threaded stud, and holes for mounting fasteners. An archery accessory mounting bracket head includes a pair of opposed grooves, and holes for mounting fasteners. The rotatable mounting bracket head is rotatable about an axis of the threaded stud. A tension nut secures the rotatable mounting bracket head with the threaded stud on archery accessory mounting bracket base.

Accordingly, it is an object of the present invention to provide an archery accessory mounting base that allows for multiple types and positions of mounting of archery accessories.

It is another object of the present invention to provide an archery accessory mounting base that allows for three hundred sixty degrees of rotation of an archery accessory about the archery accessory mounting base.

Finally, it is another object of the present invention to provide an archery accessory mounting bracket having a plurality of uses and mounting provisions, an archery accessory may be operably engaged and removed from the archery accessory mounting bracket, wherein the archery accessory mounting bracket may be worn on a belt; and engaged with any end use article, such as a bow, a tree or a tree stand.

These and additional objects, advantages, features and benefits of the present invention will become apparent from the following specification.

DETAILED DESCRIPTION OF THE PREFERRED EMBODIMENTS

Figure 1A:
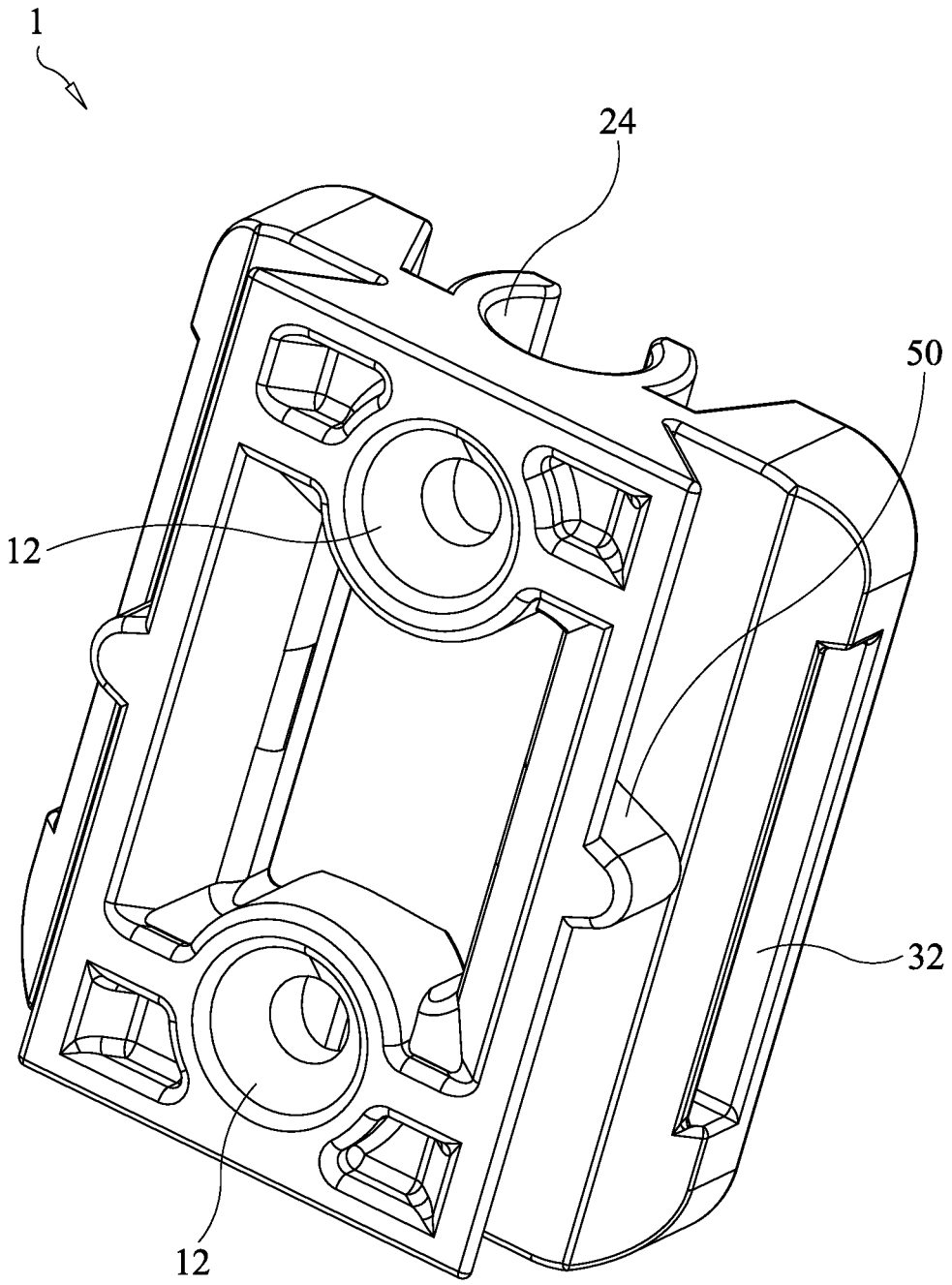
FIG. 1A is a front perspective view of an archery accessory mounting bracket in accordance with the present invention.
Figure 1B:
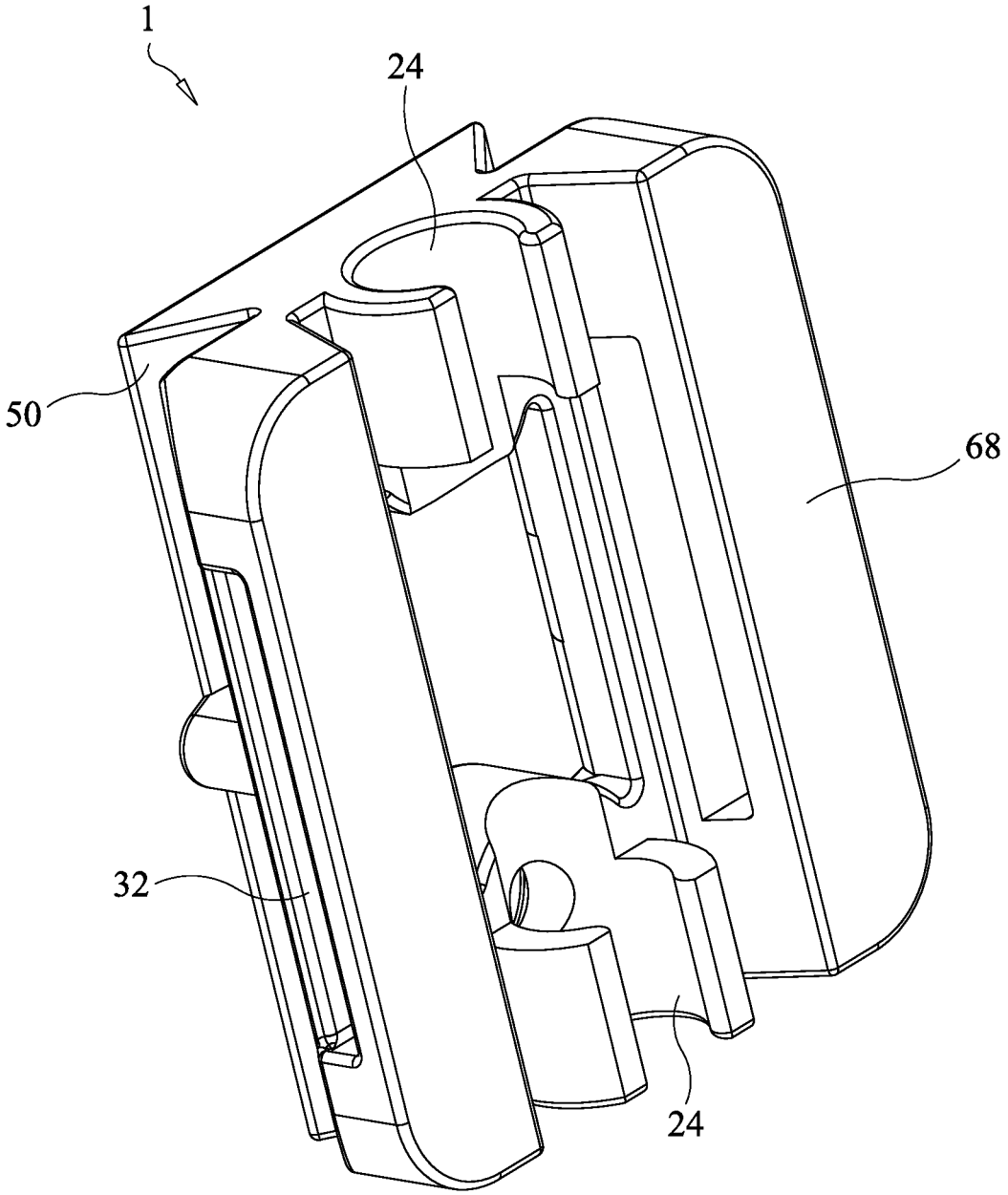
FIG. 1B is a rear perspective view of an archery accessory mounting bracket in accordance with the present invention.

FIGS. 1A and 1B disclose an archery accessory mounting bracket 1 in accordance with the present invention. The archery accessory mounting bracket 1 includes at least one fastener opening 12 formed through a thickness thereof; at least one t-screw mount receiver 24 formed in a rear thereof; a belt receiver opening 32 formed through a width thereof, and a pair of opposed grooves 50 formed along a length and on a front surface thereof; and an end use article engagement surface 68 formed on a rear surface thereof. The at least one t-screw mount receiver 24 is capable of receiving and retaining an object having a round shape. The at least one fastener opening 12 is formed on the same axis as the at least one t-screw mount receiver 24. The at least one t-screw mount receiver 24 is formed on a lengthwise axis of the archery accessory mounting bracket 1.

Figure 2A:
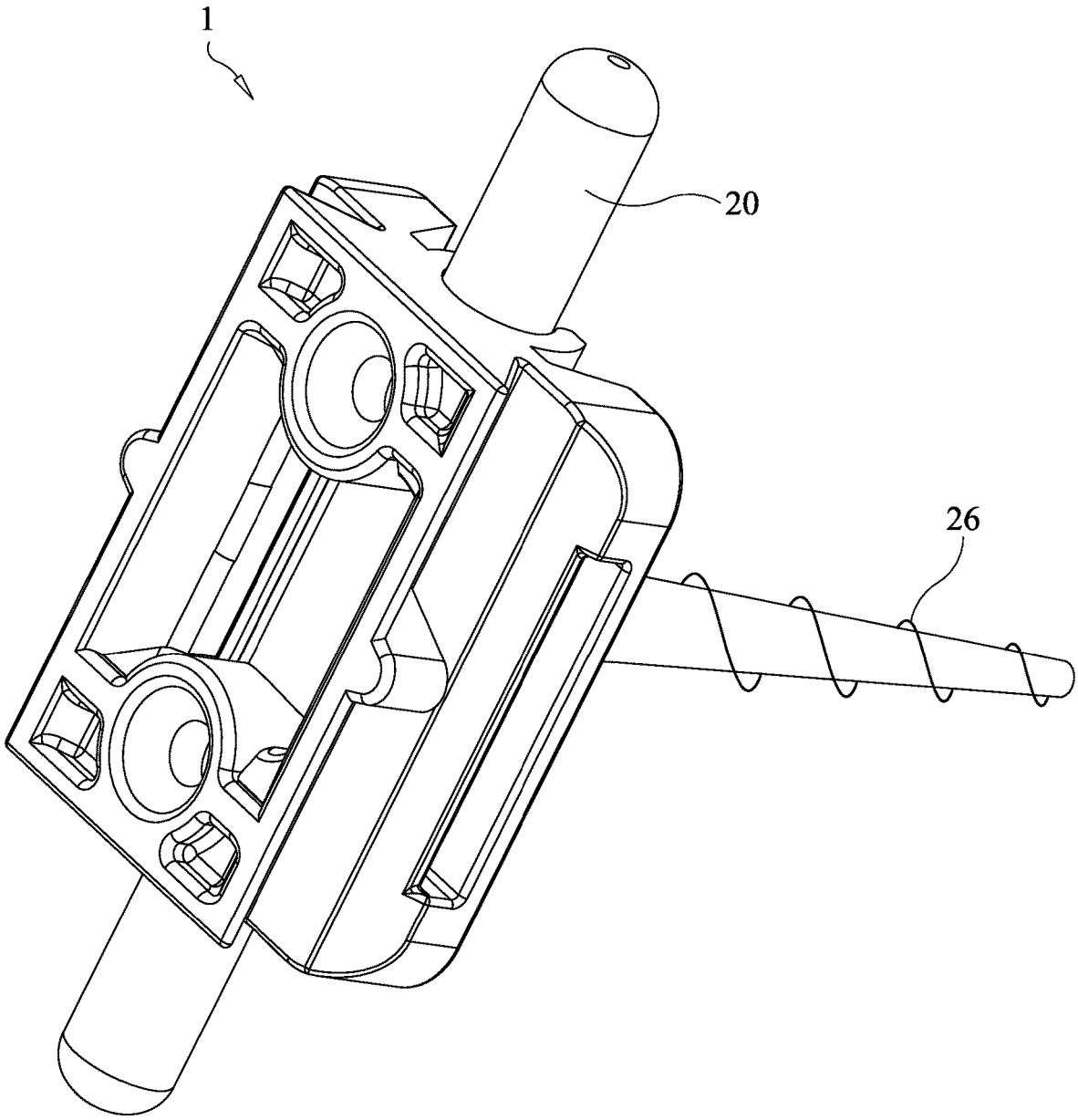
FIG. 2A is a front perspective view of an archery accessory mounting bracket with the insertion of a t-screw in accordance with the present invention.
Figure 2B:
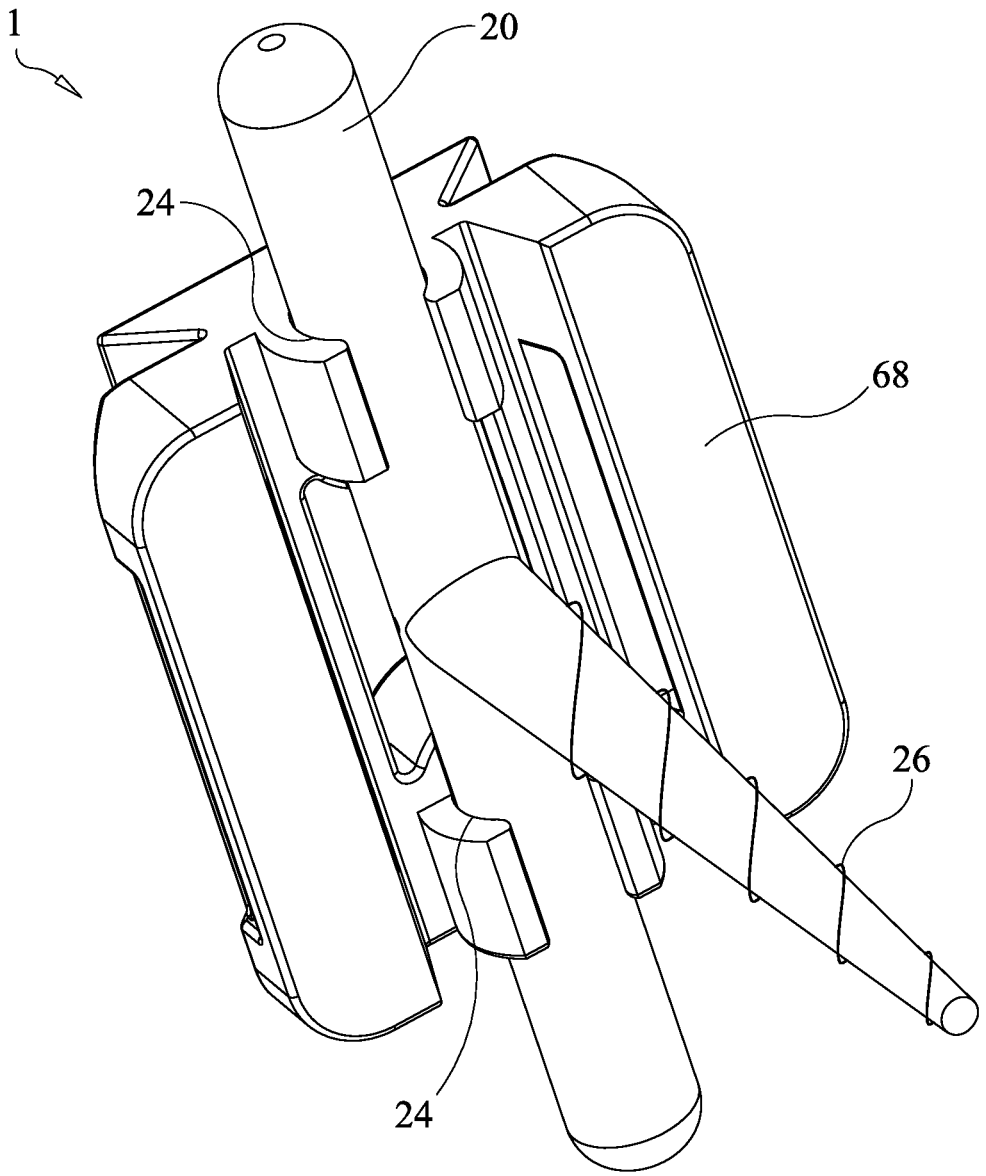
FIG. 2B is a rear perspective view of an archery accessory mounting bracket with the insertion of a t-screw in accordance with the present invention.

FIGS. 2A and 2B disclose an archery accessory mounting bracket 1 retaining a t-screw 20 in the at least one t-screw mount receiver opening 24. The t-screw 20 includes an elongated base member and a threaded member 26 extending from the elongated base member and perpendicular thereto. The threaded member 26 is structured for engagement in a tree or the like. A length of the elongated base is longer than a length of the archery accessory mounting bracket 1.

Figure 3:
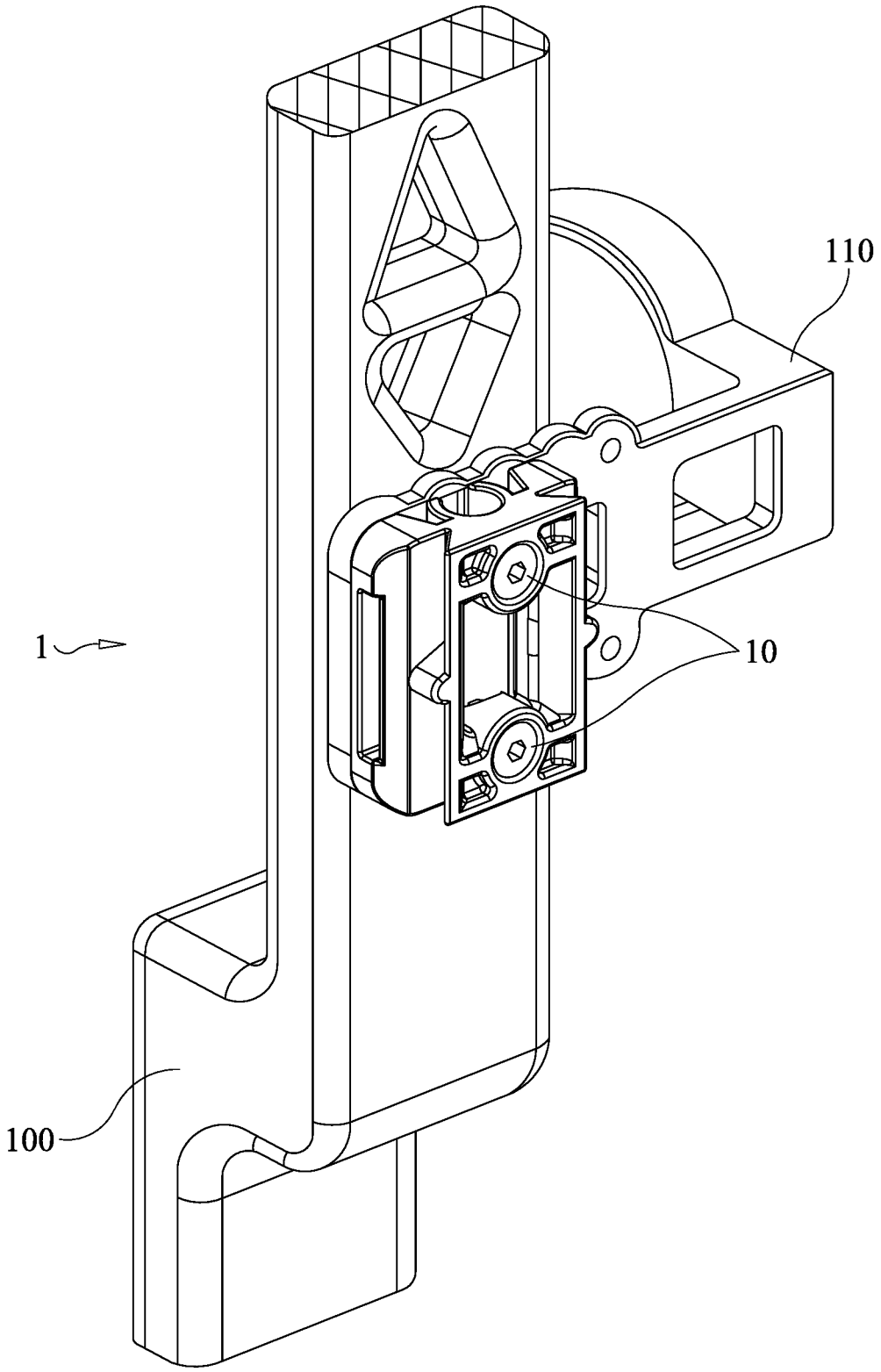
FIG. 3 is a side perspective view of an archery accessory mounting bracket engaged with a bow riser in accordance with the present invention.
Figure 4:
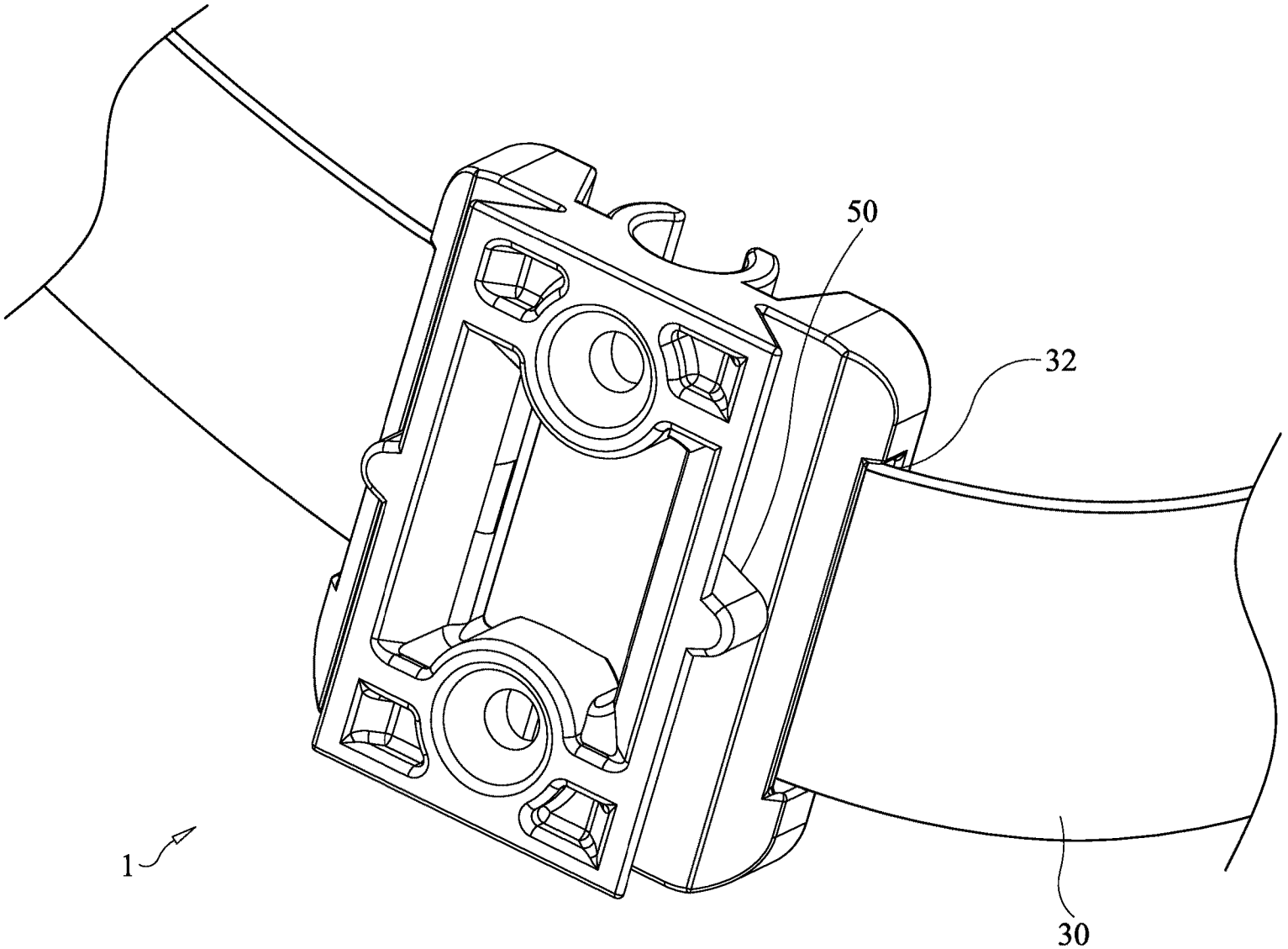
FIG. 4 is a front perspective view of an archery accessory mounting bracket with a belt inserted there though in accordance with the present invention.

FIG. 3 discloses an archery accessory mounting bracket 1 in contact with a bow sight 110 and secured to a bow riser 100 with two fasteners 10. The end use article engagement surface 68 is in contact with the bow sight 110. FIG. 4 discloses an archery accessory mounting bracket 1, wherein a belt 30 is inserted through the belt receiver opening 32 of the archery accessory mounting bracket 1. The belt receiver opening 32 is sized to receive the belt 30. The belt 30 may be engaged with the user, a tree, or any such object for attaching the archery accessory mounting bracket 1 thereto.

Figure 1C:
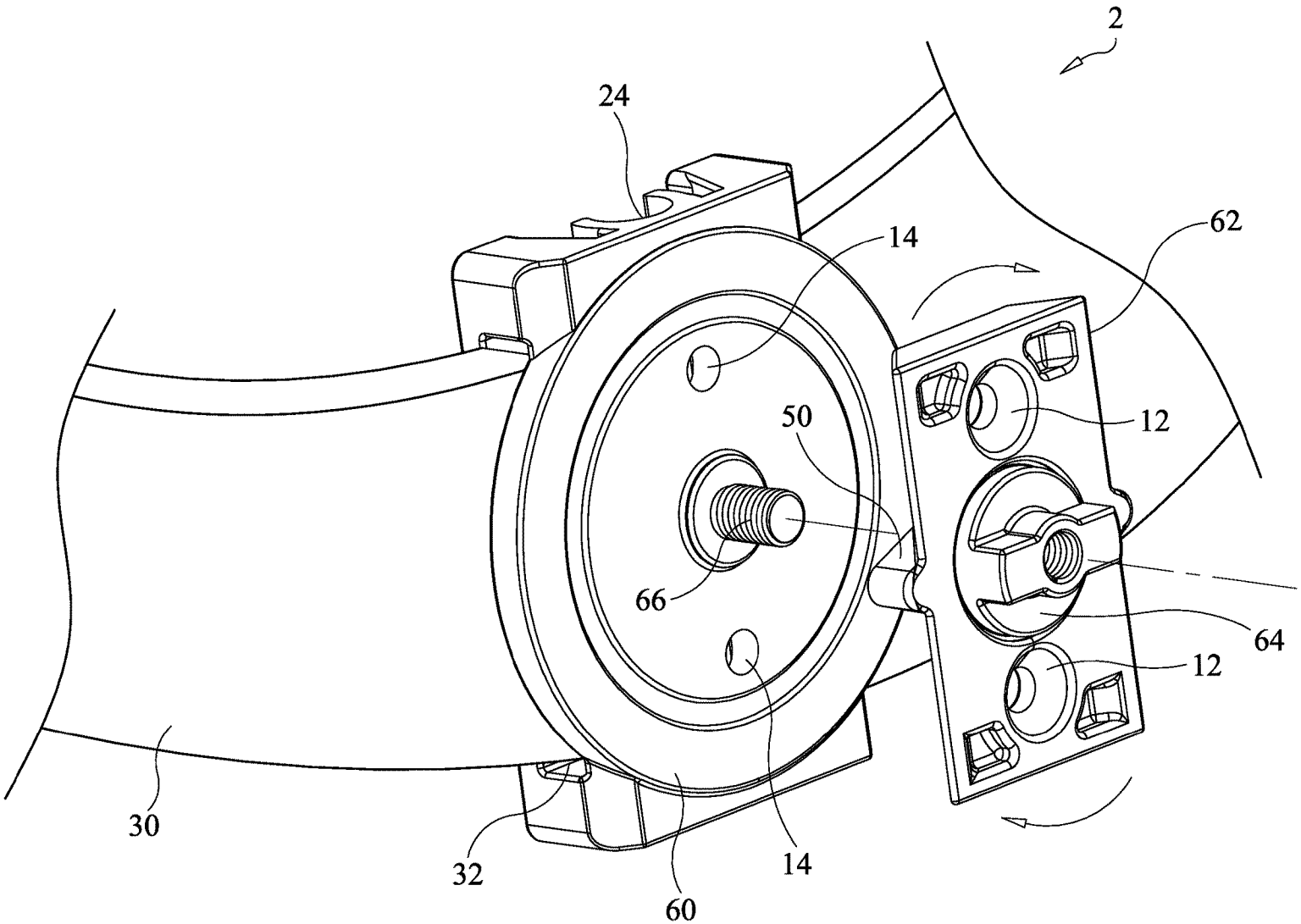
FIG. 1C is a front perspective view of an archery accessory mounting bracket, wherein a mounting bracket head is rotatable three hundred sixty degrees in accordance with the present invention.

FIG. 1C discloses an archery accessory mounting bracket assembly 2. The archery accessory mounting bracket assembly 2 includes a base 60, at least one threaded tap 14, the at least one t-screw mount receiver 24, the belt receiver opening 32, and a threaded stud 66. A three hundred sixty degree rotatable mounting bracket head 62 includes the at least one fastener opening 12, a stud opening (not shown) and the pair of opposed grooves 50. The three hundred sixty degree rotatable mounting bracket head 62 is rotatable about an axis of the threaded stud 66. A tension nut 64 is threaded on to the threaded stud 66 to prevent rotation of the mounting bracket head 62 relative to the base 60.

Figure 5:
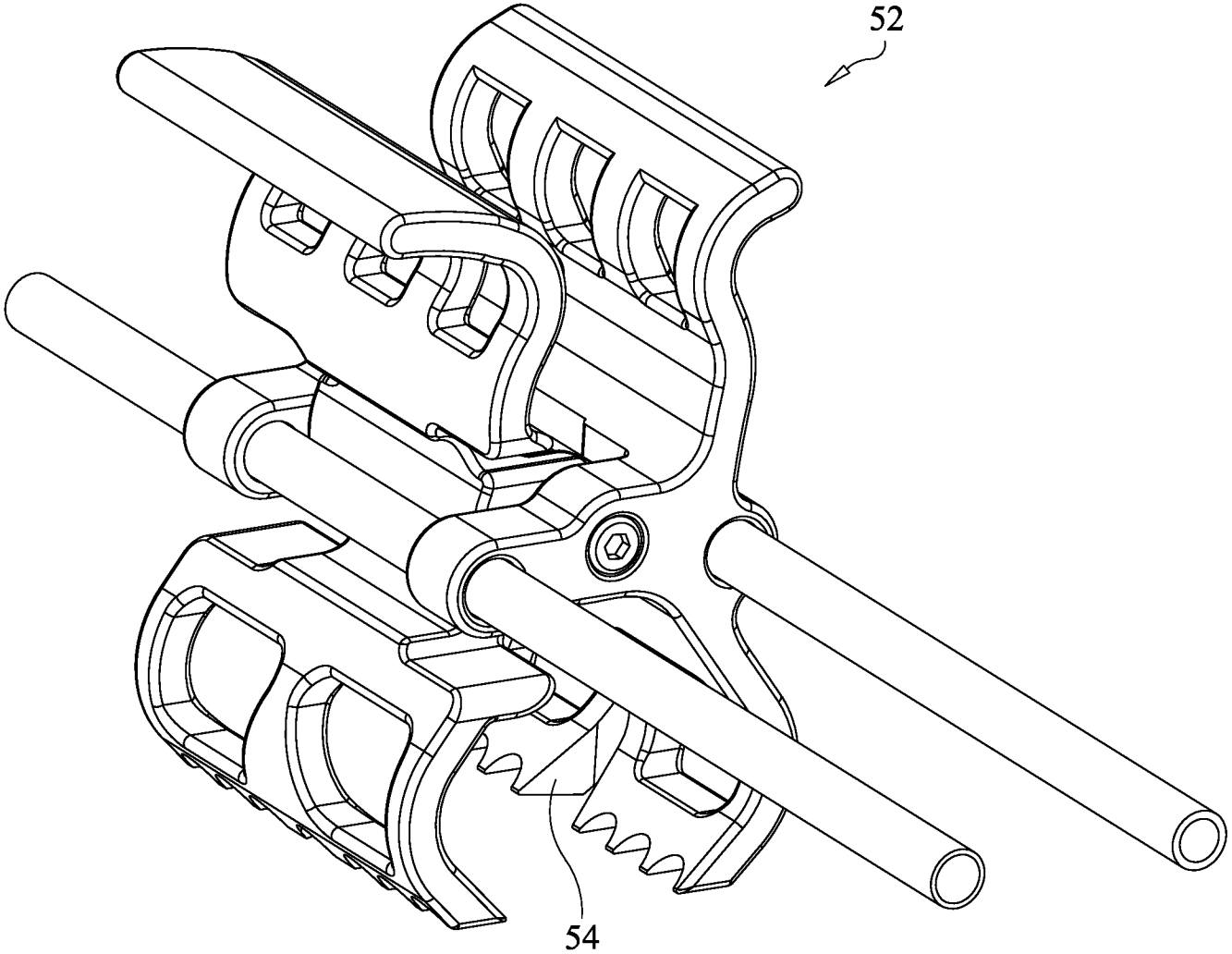
FIG. 5 is a perspective view of a representative jaw assembly, the representative jaw assembly is used for mounting an archery accessory to the archery accessory mounting bracket, wherein the representative jaw assembly engages a pair of opposed grooves in accordance with the present invention.

FIG. 5 illustrates a type of archery accessory mounting jaw assembly 52 disclosed in U.S. Pat. No. 8,505,527 to Kempf ('527 patent), which is hereby incorporated by reference in its entirety. The jaw assembly 52 has an archery accessory mounting bracket engagement surface 54, which is engaged with the pair of opposed grooves 50 of the archery accessory mounting bracket 1 and the mounting bracket head 62 when engaged with the base 60. Many types of archery accessories may be engaged with the jaw assembly 52.

In use, an archery quiver 30 ('527 patent) is coupled with the jaw assembly 52. A user squeezes the jaw assembly 52 and engages the archery accessory mounting bracket engagement surface 54 with the pair of opposed grooves 50 of the archery accessory mounting bracket 1, or the mounting bracket head 62 when engaged with the base 60. The user may have multiple archery accessory mounting brackets 1 attached to the user's belt 30 as shown in FIG. 4. The multiple accessory mounting brackets 1 may also be attached to a tree stand or tree via the t-screw 20.

With reference to FIG. 1C, the archery accessory mounting bracket 2 is disclosed as a belt 30 inserted through the belt receiver opening 32 of the archery accessory mounting bracket 2. In use, the three hundred sixty degree rotatable mounting bracket head 62 is rotated by the user to the desired degree of rotation, and the tension nut 64 is tightened on the threaded stud 66 to prevent further rotation of the three hundred sixty degree rotatable mounting bracket head 62. In a preferred embodiment, an archery quiver is coupled with the jaw assembly 52 as illustrated in the '527 patent. A user squeezes the jaw assembly 52 and engages the archery accessory mounting bracket engagement surface 54 with the pair of opposed grooves 50 of the three hundred sixty degree rotatable mounting bracket head 62. The user may have multiple three hundred sixty degree rotatable mounting bracket heads 62 retained on the user's belt 30. The rotatable mounting bracket head 62 may also be attached to a riser, and attached to a tree or tree stand with the t-screw 20.

Although the figures in this application illustrate a preferred embodiment of the present invention, alternative designs assembly methods may be accomplished by altering the number of components, manufacturing practices, tension alternatives, materials, size, and methods to accomplish the end result accordingly. In addition to the use of the t-screw 20 in the t-screw mount receiver 24, other objects, such as a tube of any shape or size may be retained in a modified t-screw mount receiver 24 for the archery accessory mounting bracket 1 or the archery accessory mounting bracket assembly 2.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention. The invention shall not be limited to archery accessories, the invention may be used in any field allowing the use of a mounting bracket and an attachment device as prescribed in the disclosure.

I claim:

1. An archery accessory mounting bracket comprising:

a first structure having a first receiver opening, a second structure having a second receiver opening, said first structure is retained on a rear of said archery accessory mounting bracket at a first end, said second structure is retained on said rear of said archery accessory mounting bracket at a second end, a lengthwise axis passes through said first and second receiver openings, a width of said receiver opening is less than a width of said archery accessory mounting bracket, said first and second receiver openings are sized to retain a cylindrical object to not allow radial movement thereof; and a belt receiver opening having an axis formed through a width of said archery accessory mounting bracket, said belt receiver opening is sized to receive a belt worn around a human body or secured around an object, a belt inserted through said belt receiver opening passes through said axis of said receiver opening.

2. The archery accessory mounting bracket of claim 1 wherein:

an inner perimeter of said receiver opening is sized to receive an object with a round shape.

3. An archery accessory mounting bracket comprising:

a belt receiver opening is formed through a width of said archery accessory mounting bracket for receiving a belt, wherein the belt is worn around a human body or wrapped around an object; and a pair of opposed grooves are formed along opposing outer sides of a length of said archery accessory mounting bracket, said pair of opposed grooves are sized to receive a portion of a component, said pair of opposed grooves extend an entire length of said archery accessory mounting bracket, a lengthwise axis of said opposed grooves are perpendicular to a lengthwise axis of said belt receiver opening.

4. The archery accessory mounting bracket of claim 3 wherein:

a projection extends outward from each one of said pair of opposed grooves.

* * * * *